US010745998B2

(12) United States Patent
Prost et al.

(10) Patent No.: US 10,745,998 B2
(45) Date of Patent: Aug. 18, 2020

(54) MULTI-MODE CONTROL MODULE

(71) Applicant: SCHLUMBERGER TECHNOLOGY CORPORATION, Sugar Land, TX (US)

(72) Inventors: Jerome Prost, Clamart (FR); Emrah Gokdag, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 15/567,981

(22) PCT Filed: Apr. 21, 2015

(86) PCT No.: PCT/US2015/026768
§ 371 (c)(1),
(2) Date: Oct. 20, 2017

(87) PCT Pub. No.: WO2016/171664
PCT Pub. Date: Oct. 27, 2016

(65) Prior Publication Data

US 2018/0119522 A1 May 3, 2018

(51) Int. Cl.
*E21B 41/00* (2006.01)
*E21B 23/04* (2006.01)
*E21B 34/06* (2006.01)

(52) U.S. Cl.
CPC ..... *E21B 41/00* (2013.01); *E21B 23/04* (2013.01); *E21B 34/066* (2013.01)

(58) Field of Classification Search
CPC ..... E21B 23/04; E21B 41/00; E21B 34/066
See application file for complete search history.

(56) References Cited

U.S. PATENT DOCUMENTS

| | | | |
|---|---|---|---|
| 3,970,034 | A | 7/1976 | Kirk |
| 4,636,934 | A | 1/1987 | Schwendemann et al. |
| 4,942,926 | A | 7/1990 | Lessi |
| 5,832,996 | A | 11/1998 | Carmody et al. |
| 6,279,651 | B1 | 8/2001 | Schwendemann et al. |
| 6,786,285 | B2 | 9/2004 | Johnson et al. |
| 7,195,033 | B2 | 3/2007 | Mayeu et al. |
| 7,387,165 | B2 | 6/2008 | Lopez de Cardenas et al. |
| 7,954,552 | B2 | 6/2011 | Mandrou et al. |

(Continued)

FOREIGN PATENT DOCUMENTS

| | | | |
|---|---|---|---|
| WO | 9809055 | A1 | 3/1998 |
| WO | 9947790 | A1 | 9/1999 |
| WO | 2012039620 | A1 | 3/2012 |

OTHER PUBLICATIONS

PCT/US2011/052255, International Search Report and Written Opinion, dated Jun. 19, 2012, 12 pages.

*Primary Examiner* — Tara E Schimpf
*Assistant Examiner* — Manuel C Portocarrero

(57) ABSTRACT

A technique facilitates operation of an actuator via an operating module. The actuator and the operating module are constructed to enable operation in a wide variety of environments and applications. The operating module is coupled to the actuator and is operable in a plurality of modes, such as an electro-hydraulic mode, a pure hydraulic mode, and a mechanical mode. A desired mode of operation is selected and the operating module enables shifting of the actuator via the selected mode.

18 Claims, 10 Drawing Sheets

(56) References Cited

U.S. PATENT DOCUMENTS

| | | | | |
|---|---|---|---|---|
| 8,360,158 | B2 | 1/2013 | Mandrou et al. | |
| 9,228,423 | B2 | 1/2016 | Powell et al. | |
| 2006/0192160 | A1 | 8/2006 | Cove | |
| 2006/0196660 | A1 | 9/2006 | Patel | |
| 2007/0163774 | A1 | 7/2007 | Hosatte et al. | |
| 2009/0014168 | A1 | 1/2009 | Tips et al. | |
| 2009/0050333 | A1 | 2/2009 | Smith et al. | |
| 2009/0283276 | A1 | 11/2009 | Mandrou et al. | |
| 2010/0006295 | A1 | 1/2010 | Goughnour et al. | |
| 2011/0284241 | A1 | 11/2011 | Mandrou et al. | |
| 2012/0067593 | A1 | 3/2012 | Powell et al. | |
| 2014/0286129 | A1* | 9/2014 | Longfield ..... | E21B 47/14 367/33 |
| 2020/0038093 | A1 | 2/2020 | Onik | |

* cited by examiner

MULTI-MODE CONTROL MODULE

BACKGROUND

Hydraulic actuators are used in a variety of applications to enable selective actuation of a corresponding device. In well applications, for example, hydraulic actuators are combined with tubing strings and used in many types of downhole applications. The hydraulic actuators may be coupled with a variety of well tools employed in production operations, injection operations, and/or other types of well related operations. Hydraulic fluid is supplied to the downhole actuator under pressure and used to actuate the hydraulic actuator and thus the corresponding well tool. The hydraulic fluid may be supplied via well tubing, an annulus, or hydraulic control lines.

SUMMARY

In general, a system and methodology are provided for facilitating operation of an actuator via an operating module in a wide variety of environments and applications. The operating module is coupled to the actuator and is operable in a plurality of modes, such as an electro-hydraulic mode, a pure hydraulic mode, and a mechanical mode. A desired mode of operation is selected and the operating module enables shifting of the actuator via the selected mode.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology which may be used to facilitate actuation of devices in a variety of well and non-well applications. The technique utilizes an operating module coupled to an actuator which, in turn, may be coupled to an actuatable device, e.g. well tool. The operating module and actuator are operable in a plurality of modes, e.g. an electro-hydraulic mode, a pure hydraulic mode, and a mechanical mode. A desired mode of operation is selected and the operating module enables shifting of the actuator via the selected mode.

According to an embodiment, the operating module comprises an electro-hydraulic circuit used to operate a hydraulic actuator coupled with a controlled device, such as a hydraulic flow control valve, a sliding sleeve, a latching mechanism, and/or other controlled devices. In well applications, the operating module containing electro-hydraulic circuitry may be installed in downhole equipment and operated remotely from, for example, a surface control system. The operating module may be operated from the surface using hydraulic control lines for providing pressure signals and an electrical line for providing electrical power and/or control command signals. For example, electrical power and control command signals may be provided to a plurality of solenoid operated valves of the operating module.

Various embodiments of the operating module utilize different types of hydraulic and/or electrical circuits which enable actuation of the operating module according to selected modes. In some applications, the operating module may be modular in the sense that a purely hydraulic mode of operation may be enabled or disabled by adding, removing, or adjusting components of the operating module. The base operating module and hydro-electric circuitry can be constructed at a manufacturing stage with specific features that allow use of the operating module in various modes and environments to provide flexible functionality while limiting manufacturing costs.

Figure 1:
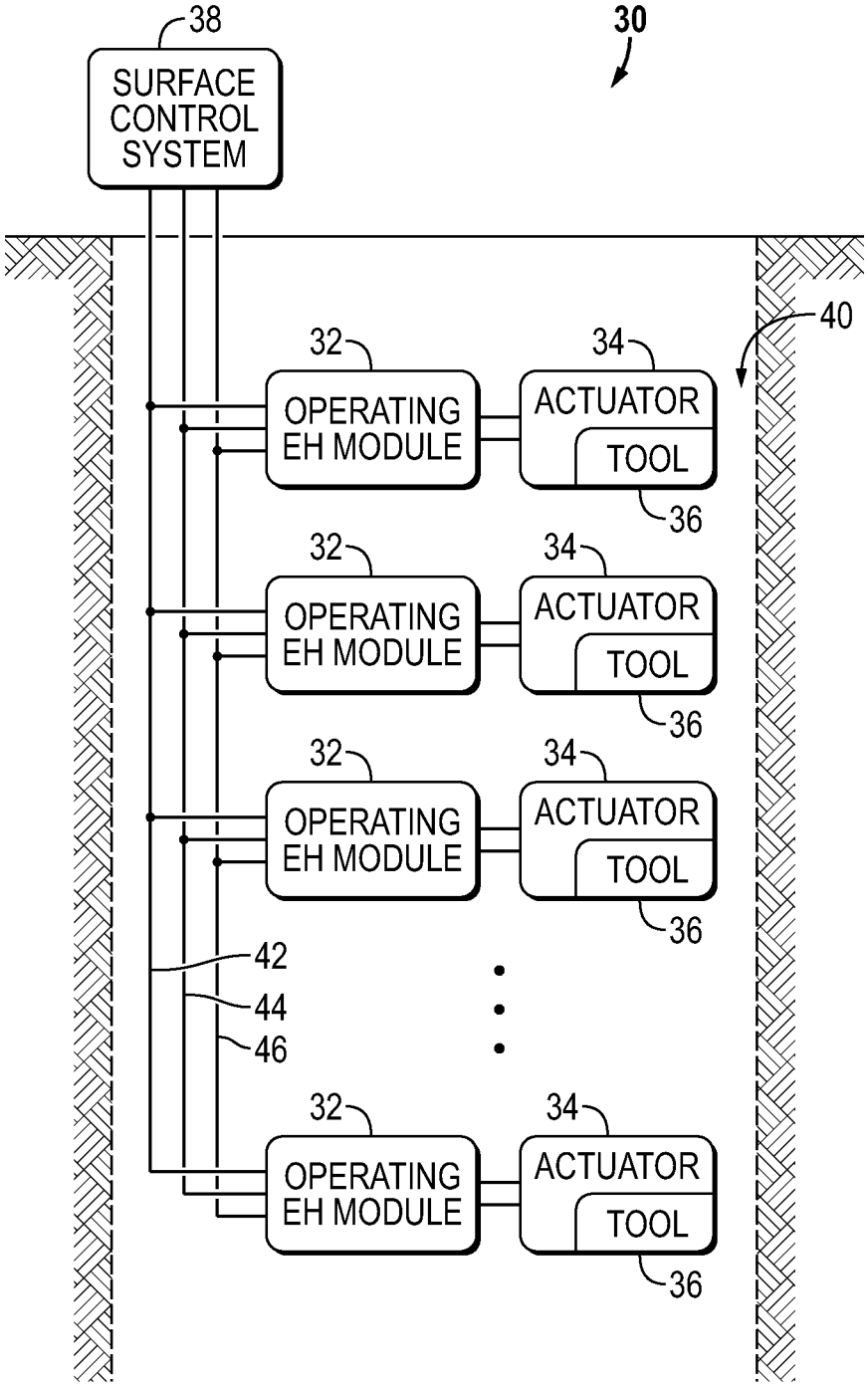
FIG. 1 is a schematic illustration of an example of a system employing a plurality of operating modules, actuators, and corresponding tools, according to an embodiment of the disclosure.

Referring generally to FIG. 1, an example of a system 30 is illustrated as having a plurality of operating module 32 hydraulically coupled with a plurality of corresponding actuators 34. In turn, the actuators 34 may be connected with a variety of corresponding devices 36, e.g. well tools, which are actuated according to signals provide from a control system 38, e.g. a surface control system. By way of example, control system 38 may be a computer control system or other processor-based control system programmed to provide the appropriate electrical and/or hydraulic signals. In the example illustrated, system 30 is a well system and the operating modules 32, actuators 34, and devices/tools 36 are located in a wellbore 40. However, system 30 may be used in a variety of non-well applications for controlling other types of devices 36.

In the embodiment illustrated, the control system 38 is operatively coupled with the operating modules 32 via an electrical line 42, a first hydraulic line 44, and a second hydraulic line 46. The control system 38 may be used to operate the plurality of operating modules 32 simultaneously. However, the control system 38 and the operating modules 32 may be constructed for individual actuation of selected operating modules 32 by utilizing control signals that are unique to each operating module 32. For example, unique electrical signals and/or hydraulic signals (e.g. different hydraulic pressure levels) may be used to actuate individual operating modules 32 and thus individual devices 36.

The system 30 may be constructed to enable multiplexing of hydraulic tools in a well or in other applications. The system configuration along with the construction of the operating modules 32 facilitates operation of a greater number of devices 36 with a lesser number of control lines 42, 44, 46. Additionally, the operating modules 32 enable selection of primary, secondary, and tertiary modes of device operation without incurring system hydraulic lock.

Examples of the primary, secondary, and/or tertiary modes of device operation comprise an electro-hydraulic mode, a pure hydraulic mode, and a mechanical mode. The electro-hydraulic mode enables use of a given operating module 32 to actuate the corresponding actuator 34 in a plurality of directions, e.g. back and forth directions. The electro-hydraulic mode utilizes a hydraulic pressure signal transmitted through at least the first hydraulic control line 44 and an electrical command and power signal transmitted through the electrical control line 42. The pure hydraulic mode enables use of the given operating module 32 to actuate the corresponding actuator 34 in a given direction. This mode of operation is purely hydraulic and does not use an electrical power signal nor an electrical control signal provided from control system 38. The mechanical mode provides a mechanical intervention mode in which the actuator 34 is moved mechanically without incurring hydraulic lock in the corresponding operating module 32 or the overall system 30. By way of example, the mechanical intervention mode may be performed by using an external shifting tool which engages the appropriate hydraulic actuator 34.

Figure 2:
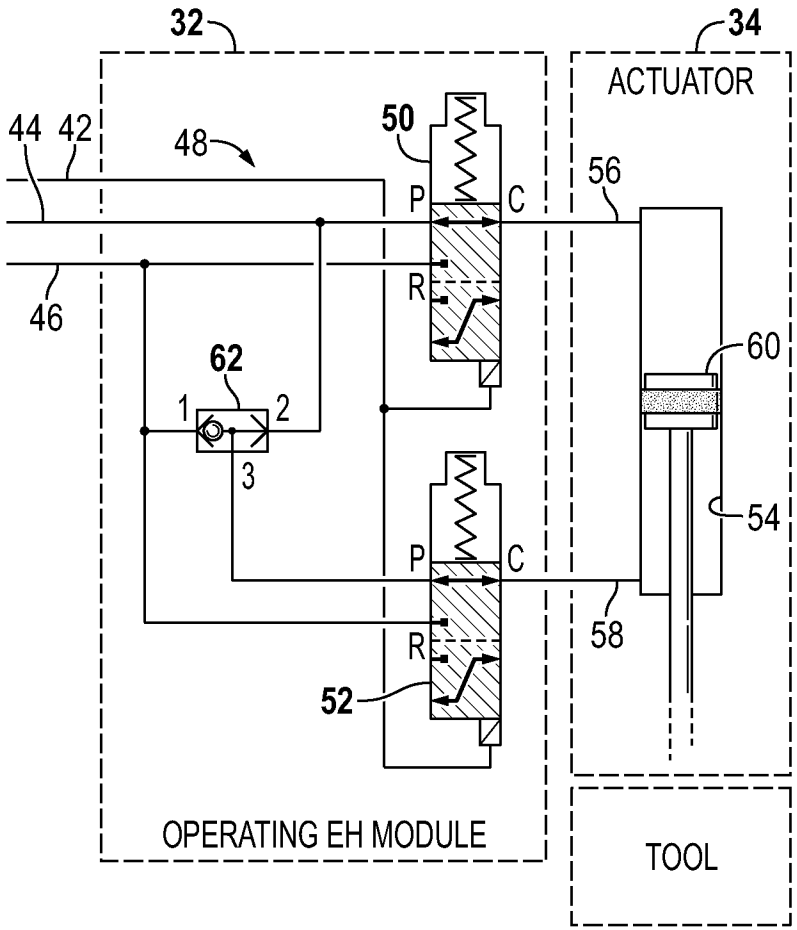
FIG. 2 is a schematic illustration of an example of an operating module coupled with an actuator, according to an embodiment of the disclosure.

Referring generally to FIG. 2, an example of operating module 32 coupled with actuator 34, e.g. a hydraulic actuator, is illustrated. In this embodiment, operating module 32 comprises an electro-hydraulic circuit 48 having a first solenoid operated valve 50 and a second solenoid operated valve 52. Various types of solenoid valves may be used in circuit 48, but the illustrated solenoid valves 50, 52 are three-way, two-position solenoid valves each having a port P, a port C, and a port R. The first solenoid valve 50 and the second solenoid valve 52 are individually energized and thus actuated via specific signals supplied by control system 28 via electrical line 42.

In this example, the ports P are fluidly coupled with first hydraulic line 44 and ports R are coupled with second hydraulic line 46. The ports C are coupled with hydraulic actuator 34. For example, port C of first solenoid valve 50 may be fluidly coupled with a piston chamber 54 of actuator 34 via a hydraulic flow passage 56. Similarly, port C of second solenoid valve 52 may be fluidly coupled with piston chamber 54 via a hydraulic flow passage 58. In this example, an actuator piston 60 is movably, e.g. slidably, disposed in piston chamber 54, and actuator piston 60 is operably connected with the corresponding device 36, e.g. well tool 36. The first solenoid valve 50 and hydraulic flow line 56 control fluid flow with respect to piston chamber 54 on one side of actuator piston 60 while second solenoid valve 52 and hydraulic flow line 58 control fluid flow with respect to piston chamber 54 on the other side of actuator piston 60.

Referring again to FIG. 2, the illustrated embodiment of operating module 32 further comprises a shuttle valve 62. An example of shuttle valve 62 comprises three ports labeled ports 1, 2 and 3. Port 1 is fluidly coupled with second hydraulic line 46 between ports R of solenoid valves 50, 52. Additionally, ports 2 and 3 are fluidly coupled with first hydraulic line 44 between port P of first solenoid valve 50 and port P of second solenoid valve 52, respectively. The shuttle valve 62 may be used to select the source of high pressure hydraulic fluid flow which flows through the appropriate port C with respect to actuator 34. As illustrated in the embodiment of FIG. 3, some embodiments of shuttle valve 62 utilize a spring 64 which spring biases the shuttle valve 62 to a defined or predetermined default position.

Figure 3:
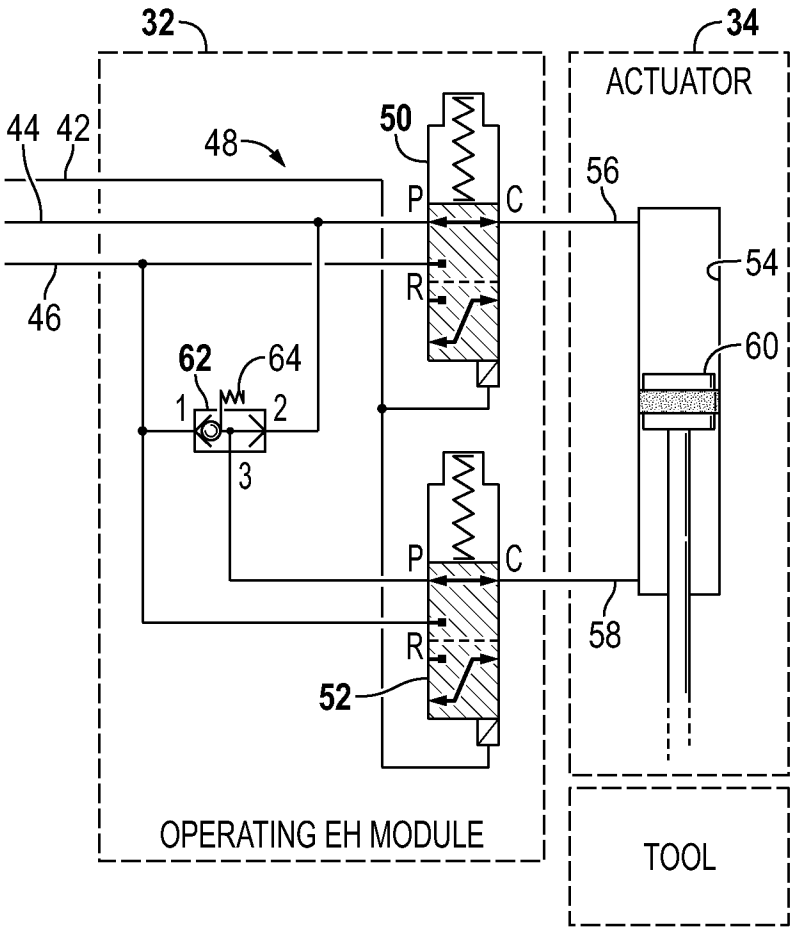
FIG. 3 is a schematic illustration of another example of an operating module coupled with an actuator, according to an embodiment of the disclosure.

The embodiments of operating module 32 illustrated in FIGS. 2 and 3 are based on normally open solenoid valves 50, 52. In other words, when the solenoid valves 50, 52 are in a non-energized state the hydraulic actuating fluid in first hydraulic line 44 is in open communication with piston chamber 54 on both sides of actuator piston 60 via an open flow path between ports P and C of each solenoid valve 50, 52. In this type of arrangement, each solenoid valve 50, 52 is able to block pressure applied to port R when the solenoid valves 50, 52 are in the non-energized state.

To operate the actuator 34 and thus the corresponding device 36 in the electro-hydraulic mode, fluid in first hydraulic line 44 is pressurized and the pressurized fluid is communicated to both sides of actuator piston 60 within piston chamber 54 via open solenoid valves 50, 52. In this embodiment, both first solenoid valve 50 and second solenoid valve 52 are normally open in the non-energized state. Consequently, the pressurized hydraulic fluid in first hydraulic line 44 can flow through first solenoid valve 50 via ports P and C and through second solenoid valve 52 via ports P and C by way of flow through ports 2 and 3 of shuttle valve 62. As illustrated, port 1 of shuttle valve 62 is closed when first hydraulic line 44 is pressurized thus blocking flow through the shuttle valve from second hydraulic line 46.

Figure 4:
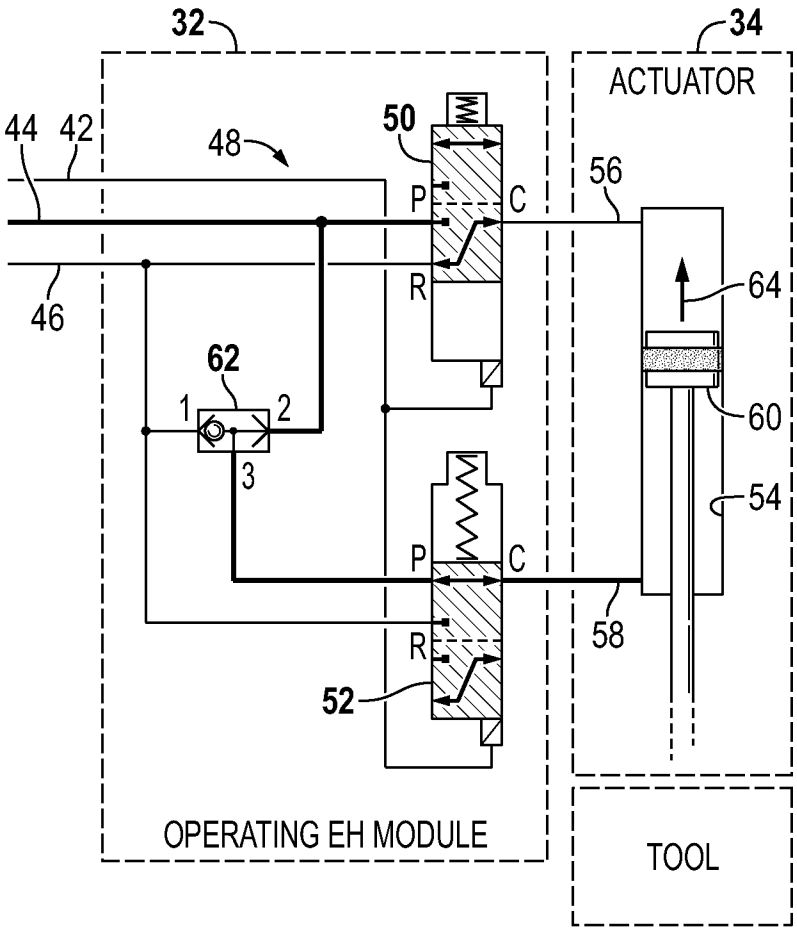
FIG. 4 is a schematic illustration similar to that of FIG. 2 but showing the operating module and actuator in a different operational position, according to an embodiment of the disclosure.

Actuation, e.g. shifting of hydraulic actuator 34, is triggered by energizing one of the solenoid valves 50 or 52. For example, the first solenoid valve 50 may be energized via a suitable electrical power and command signal supplied by electrical line 42 to cause movement of actuator piston 60 in a first direction represented by arrow 64 in FIG. 4. When the first solenoid valve 50 is energized and activated, its C port is placed in communication with its R port, thus creating a pressure differential acting on actuator piston 60 as actuating fluid flows out of piston chamber 54, through the first solenoid valve 50 via ports C and R, and then out through second hydraulic line 46. Simultaneously, high-pressure fluid from first hydraulic line 44 flows through shuttle valve 62, through second solenoid valve 52 via ports P and C, and into piston chamber 54 on an opposite side of actuator piston 60. The pressure differential created moves actuator piston 60 in the direction represented by arrow 64.

Figure 5:
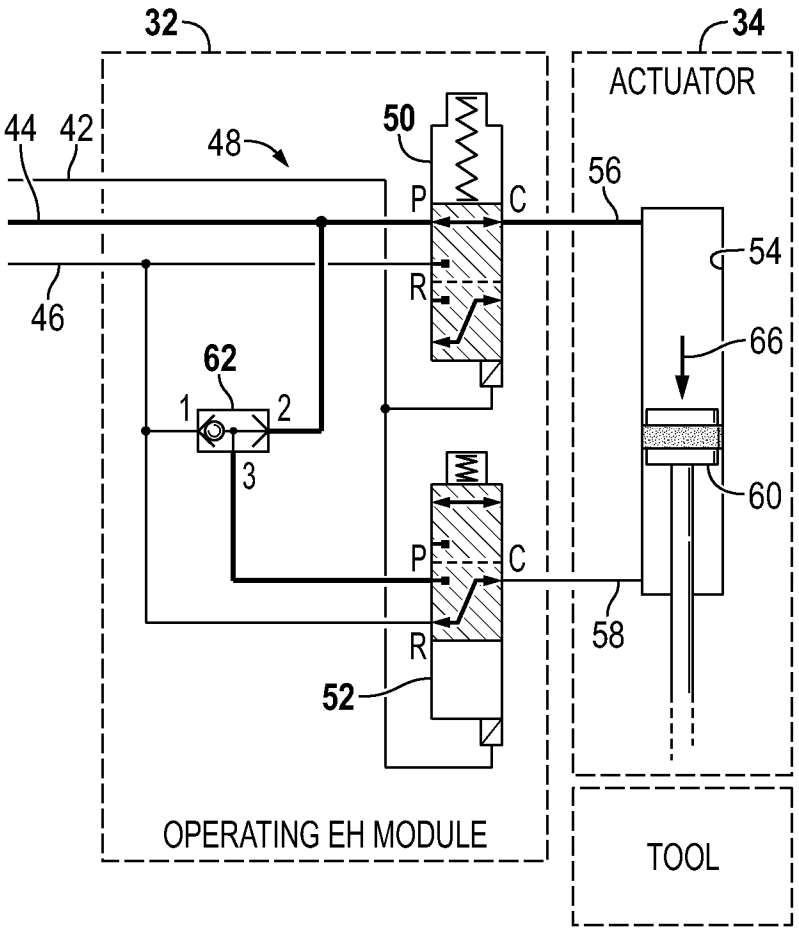
FIG. 5 is a schematic illustration similar to that of FIG. 2 but showing the operating module and actuator in a different operational position, according to an embodiment of the disclosure.

On the other hand, the second solenoid valve 52 may be energized via a suitable electrical power and command signal supplied by electrical line 42 to cause movement of actuator piston 60 in a second direction represented by arrow 66 in FIG. 5. When the second solenoid valve 52 is energized and activated, its C port is placed in communication with its R port, thus creating a pressure differential acting on actuator piston 60 as actuating fluid flows out of piston chamber 54, through the second solenoid valve 52 via ports C and R, and then out through second hydraulic line 46. Simultaneously, high-pressure fluid from first hydraulic line 44 flows through first solenoid valve 50 via ports P and C, and into piston chamber 54 on an opposite side of actuator piston 60. The pressure differential created moves actuator piston 60 in the direction represented by arrow 66.

In this example, the first solenoid valve 50 and/or the second solenoid valve 52 may be deactivated (placed in a non-energized state) by cutting the supply of electrical power via electric line 42. Once the solenoid valves 50/52 are in the non-energized state, the solenoid valves 50, 52 return to their normal open flow position which provides communication between first hydraulic line 44 and piston chamber 54 on both sides of actuator piston 60. As a result, movement of actuator piston 60 is stopped and the pressure differential across the actuator piston 60 is eliminated.

Figure 6:
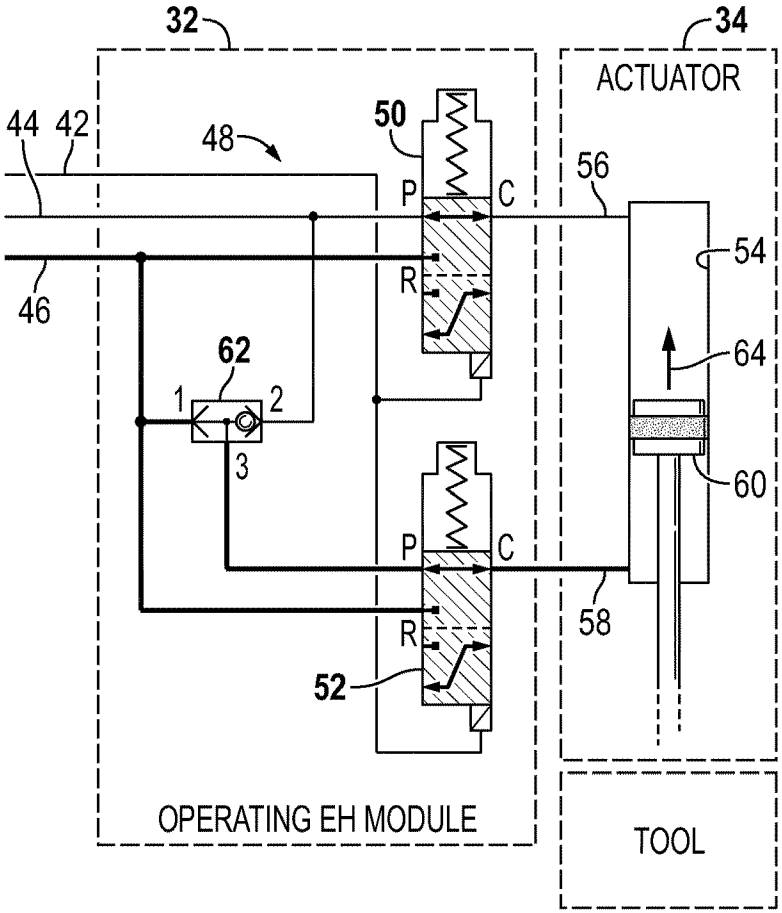
FIG. 6 is a schematic illustration similar to that of FIG. 2 but showing the operating module and actuator in a different operational position, according to an embodiment of the disclosure.

Referring generally to FIG. 6, an example of operation of the operating module 32 in a pure hydraulic mode is illustrated. In many applications, the pure hydraulic mode may be used as a contingency function which is initiated by pressurizing second hydraulic line 46 without pressurizing first hydraulic line 44. During operation in the pure hydraulic mode, the high-pressure actuating fluid in second hydraulic line 46 causes the shuttle valve 62 to shift, e.g. a ball inside the shuttle valve 62 may be moved under pressure to open port 1 and to block port 2, as illustrated in FIG. 6.

Once the shuttle valve 62 is shifted, the high-pressure fluid in second hydraulic line 46 can flow through the shuttle valve 62 and through the second solenoid valve 52 via ports P and C. This allows a higher pressure fluid to enter piston chamber 54 on one side of actuator piston 60 so as to shift the actuator piston 60 in the direction of arrow 64. The hydraulic fluid in piston chamber 54 on an opposite side of actuator piston 60 is removed through ports C and P of first solenoid valve 50 and then through first hydraulic line 44.

Figure 7:
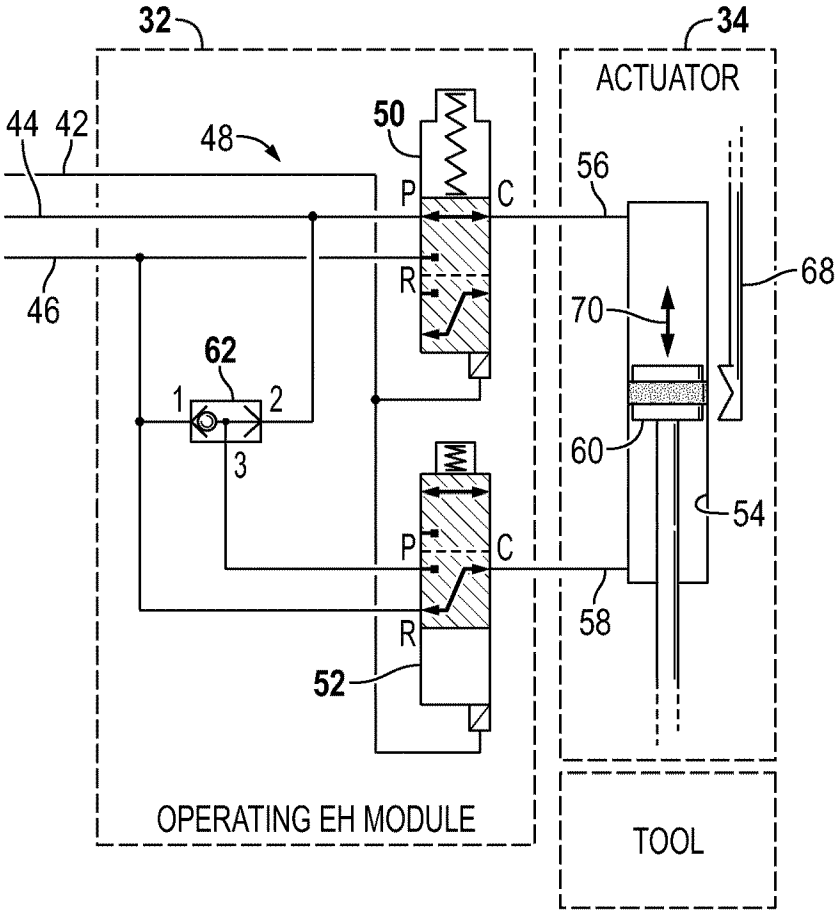
FIG. 7 is a schematic illustration similar to that of FIG. 2 but showing the operating module and actuator in a different operational position, according to an embodiment of the disclosure.

Referring generally to FIG. 7, an example of operation of operating module 32 and actuator 34 in the mechanical intervention mode is illustrated. In this example, an external tool 68 is engaged with the actuator piston 60 or with a component coupled with the actuator piston 60. The external tool 68 may be moved to shift the actuator piston in a plurality of directions, e.g. back and forth directions, as represented by arrow 70. The hydraulic circuitry of electro-hydraulic circuit 48 within operating module 32 is constructed to enable the free movement of the actuator piston 60 without incurring hydraulic lock.

As the actuator piston 60 is shifted in one direction or the other, hydraulic fluid within piston chamber 54 is allowed to drain to either first hydraulic line 44 or second hydraulic line 46 depending on the direction of the shift and the position of shuttle valve 62. As the mechanical shifting of actuator piston 60 forces hydraulic fluid out of piston chamber 54 on one side of actuator piston 60, fluid is freely allowed to flow into piston chamber 54 on an opposite side of actuator piston 60 from first hydraulic line 44 or second hydraulic line 46 depending on the position of shuttle valve 62. In some applications, the shuttle valve 62 may be spring biased to a given default position, e.g. a position in which the ball blocks flow through port 1 or port 2. In this specific spring biased example, the inflow of fluid into piston chamber 54 would be from first hydraulic line 44.

Figure 8:
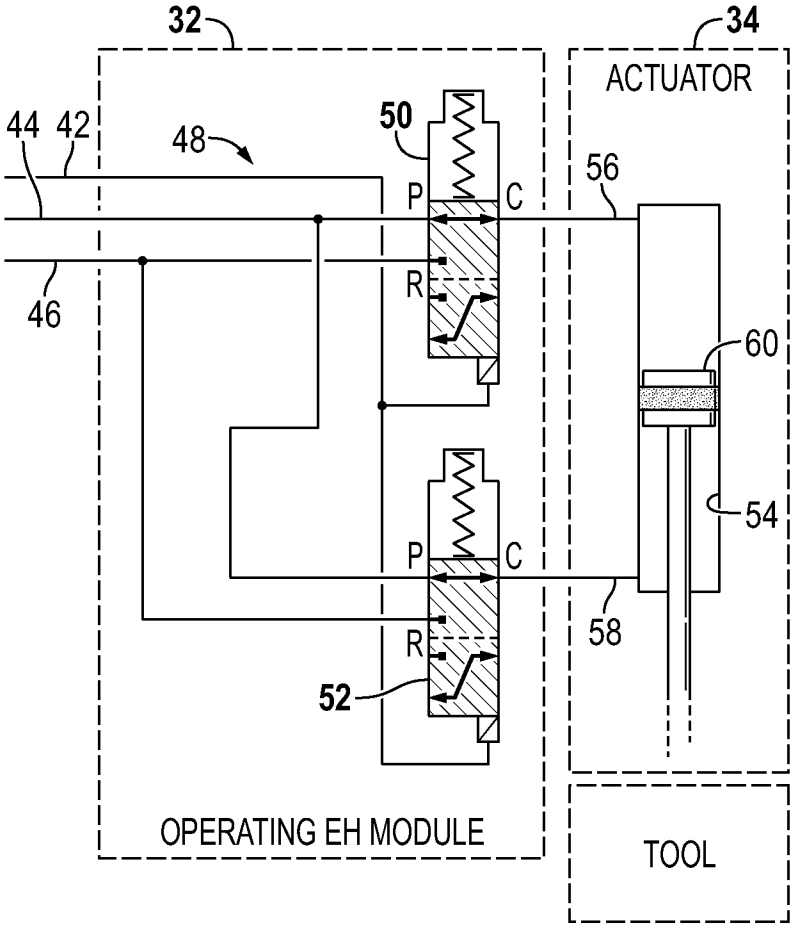
FIG. 8 is a schematic illustration of another example of an operating module coupled with an actuator, according to an embodiment of the disclosure.

It should be noted that some applications may not utilize the pure hydraulic mode. In such applications, the pure hydraulic operation function can be eliminated by removing the shuttle valve 62, as illustrated in FIG. 8. For example, the shuttle valve 62 can be removed and replaced with a plug or other suitable element which seals first hydraulic line 44 from second hydraulic line 46. However, operating module 32 may be constructed with the same type of manifold or other circuit supporting structure with or without the shuttle valve 62. This approach provides flexibility in the manufacturing process such that two functionally different systems (with and without pure hydraulic mode) may be constructed using the same base components. In some applications, the operating module 32 may be constructed to enable assembly with or without the shuttle valve functionality during final stages of the assembly.

Figure 9:
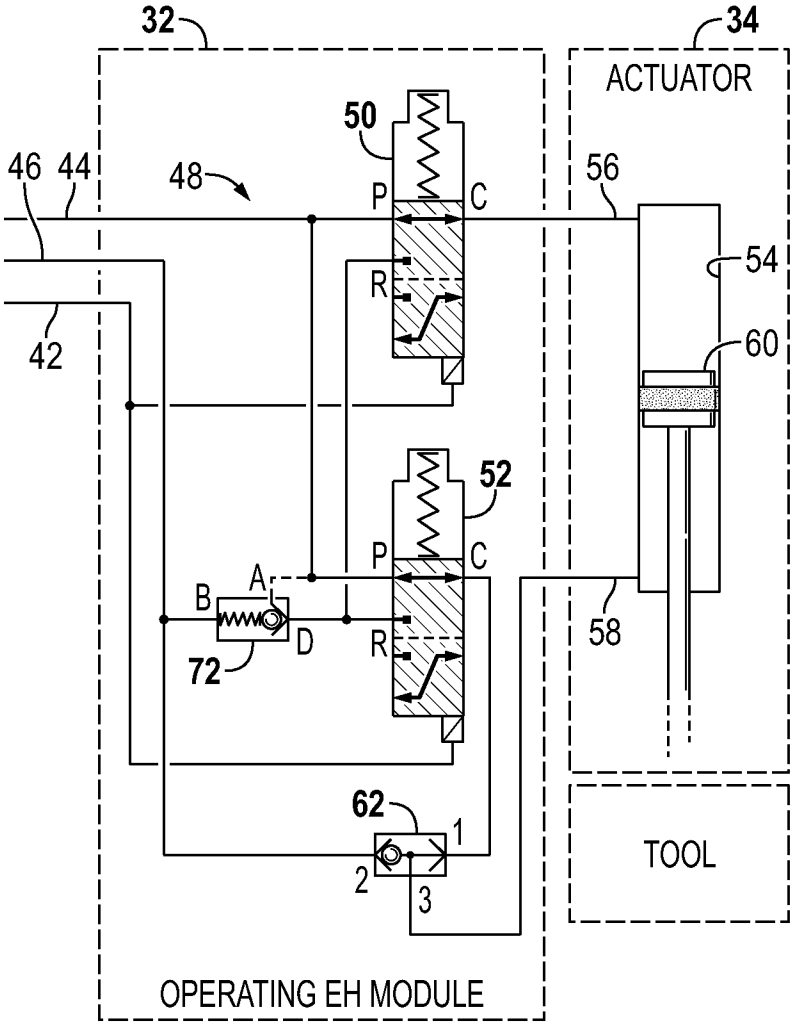
FIG. 9 is a schematic illustration of another example of an operating module coupled with an actuator, according to an embodiment of the disclosure.

Referring generally to FIG. 9, another embodiment of operating module 32 is illustrated in which the first solenoid valve 50 and the second solenoid valve 52 are in normally open configurations when they are not energized. Unlike the embodiments described with reference to FIGS. 2-7, however, pressure is not blocked at port R when the solenoid valves 50, 52 are not energized. In the embodiment of FIG. 9, the ports R act as a check valve and do not block pressure in both directions but in one single direction. The check valve functionality may be provided with a check valve 72, e.g. a piloted check valve, which has a port D fluidly coupled with ports R of first and second solenoid valves 50, 52. The piloted check valve 72 also has a port A coupled with first hydraulic line 44 and a port B coupled with second hydraulic line 46, as illustrated. If the check valve 72 is a piloted check valve, valve 72 may be piloted via pressure applied in first hydraulic line 44.

To operate actuator 34 and thus corresponding tool 36 in an electro-hydraulic mode, fluid in first hydraulic line 44 is pressurized and the pressurized fluid is communicated to both sides of actuator piston 60 within piston chamber 54 via open solenoid valves 50, 52. In this embodiment, both first solenoid valve 50 and second solenoid valve 52 are normally open when in the non-energized state and ports P and C of each solenoid valve 50, 52 are in communication by default. Pressure on the actuator piston 60 remains balanced so no movement of actuator piston 60 occurs.

Figure 10:
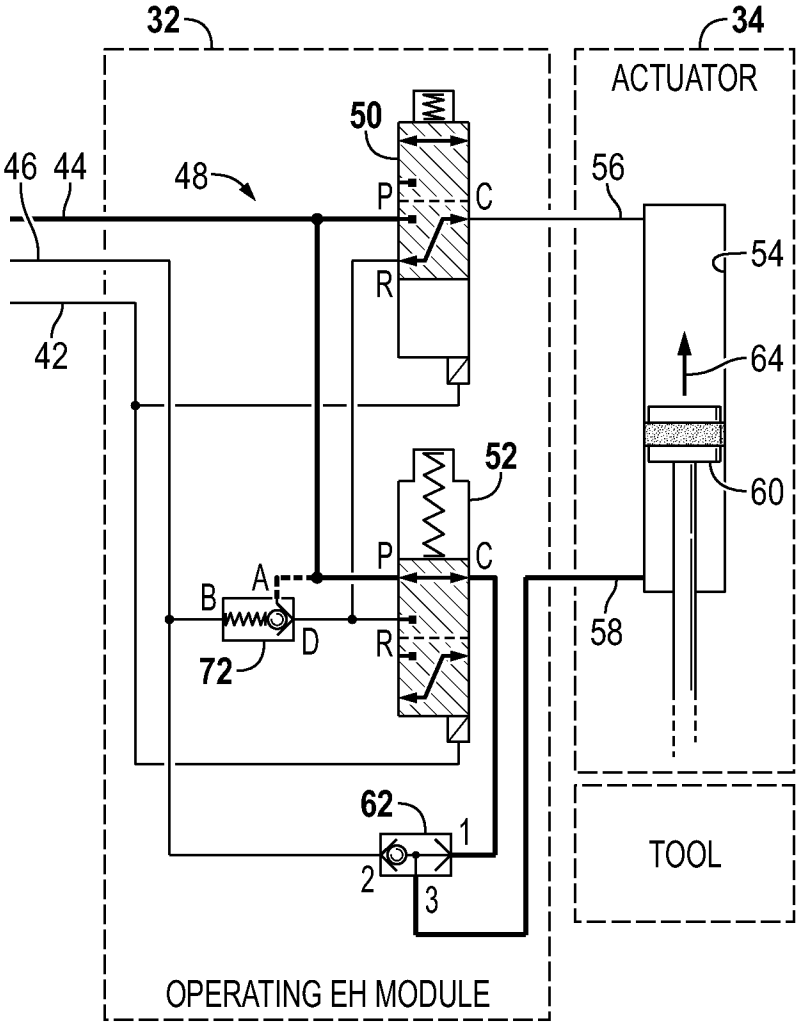
FIG. 10 is a schematic illustration similar to that of FIG. 9 but showing the operating module and actuator in a different operational position, according to an embodiment of the disclosure.

Actuation, e.g. shifting of hydraulic actuator 34, is triggered by energizing one of the solenoid valves 50 or 52. For example, the first solenoid valve 50 may be energized via a suitable electrical power and command signal supplied by electrical line 42 to cause movement of actuator piston 60 in a first direction represented by arrow 64 in FIG. 10. When the first solenoid valve 50 is energized and activated, its P port is blocked and its C port is placed in communication with its R port. This creates a pressure differential acting on actuator piston 60 as actuating fluid flows out of piston chamber 54, through the first solenoid valve 50 via ports C and R. The outflowing hydraulic fluid passes through check valve 72 (via ports D and B) and then passes out through second hydraulic line 46. Simultaneously, high-pressure fluid from first hydraulic line 44 flows through second solenoid valve 52 via ports P and C, through shuttle valve 62, and into piston chamber 54 on an opposite side of actuator piston 60. The pressure differential created moves actuator piston 60 in the direction represented by arrow 64.

Figure 11:
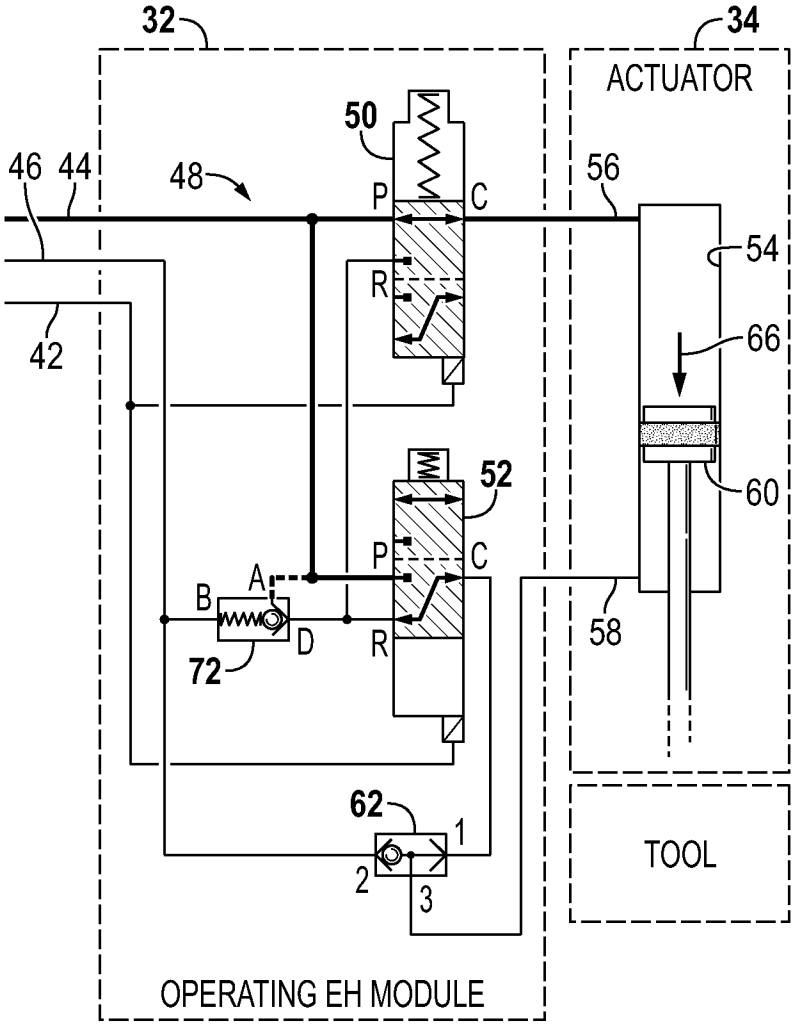
FIG. 11 is a schematic illustration similar to that of FIG. 9 but showing the operating module and actuator in a different operational position, according to an embodiment of the disclosure.

If the second solenoid valve 52 is energized via a suitable electrical power and command signal supplied by electrical line 42, then movement of actuator piston 60 is caused in a second direction represented by arrow 66 in FIG. 11. When the second solenoid valve 52 is energized and activated, its P port is blocked and its C port is placed in communication with its R port. This creates a pressure differential acting on actuator piston 60 as actuating fluid flows out of piston chamber 54, through shuttle valve 62, through the second solenoid valve 52 via ports C and R, through check valve 72, and then out through second hydraulic line 46. Simultaneously, high-pressure fluid from first hydraulic line 44 flows through first solenoid valve 50 via ports P and C, and into piston chamber 54 on an opposite side of actuator piston 60. The pressure differential created moves actuator piston 60 in the direction represented by arrow 66.

As with other embodiments described above, the first solenoid valve 50 and/or the second solenoid valve 52 may be deactivated (placed in a non-energized state) by cutting the supply of electrical power via electric line 42. Once the solenoid valves 50/52 are in the non-energized state, the solenoid valves 50, 52 return to their normal open flow position which provides communication between first hydraulic line 44 and piston chamber 54 on both sides of actuator piston 60. As a result, movement of actuator piston 60 is stopped and the pressure differential across the actuator piston 60 is eliminated.

Figure 12:
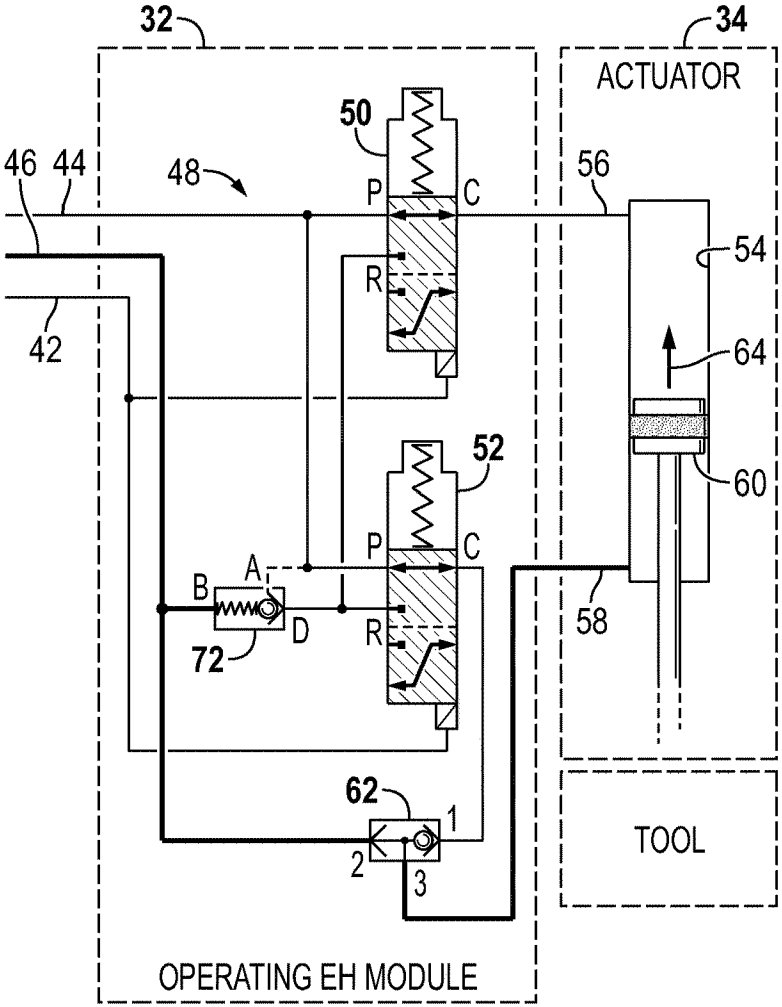
FIG. 12 is a schematic illustration similar to that of FIG. 9 but showing the operating module and actuator in a different operational position, according to an embodiment of the disclosure.

Referring generally to FIG. 12, an example of operation of the operating module 32 in a pure hydraulic mode is illustrated. In this example, the pure hydraulic mode may be used as a contingency function which is initiated by pressurizing second hydraulic line 46 without pressurizing first hydraulic line 44. During operation in the pure hydraulic mode, the high-pressure actuating fluid in second hydraulic line 46 causes the shuttle valve 62 to shift, e.g. a ball inside the shuttle valve 62 may be moved under pressure to open port 2 and to block port 1, as illustrated in FIG. 12.

Once the shuttle valve 62 is shifted, the high-pressure fluid in second hydraulic line 46 can flow through the shuttle valve 62 and into piston chamber 54 on one side of actuator piston 60. The high-pressure fluid entering piston chamber 54 shifts the actuator piston 60 in the direction of arrow 64. The hydraulic fluid in piston chamber 54 on an opposite side of actuator piston 60 is removed through ports C and P of first solenoid valve 50 and then through first hydraulic line 44.

Figure 13:
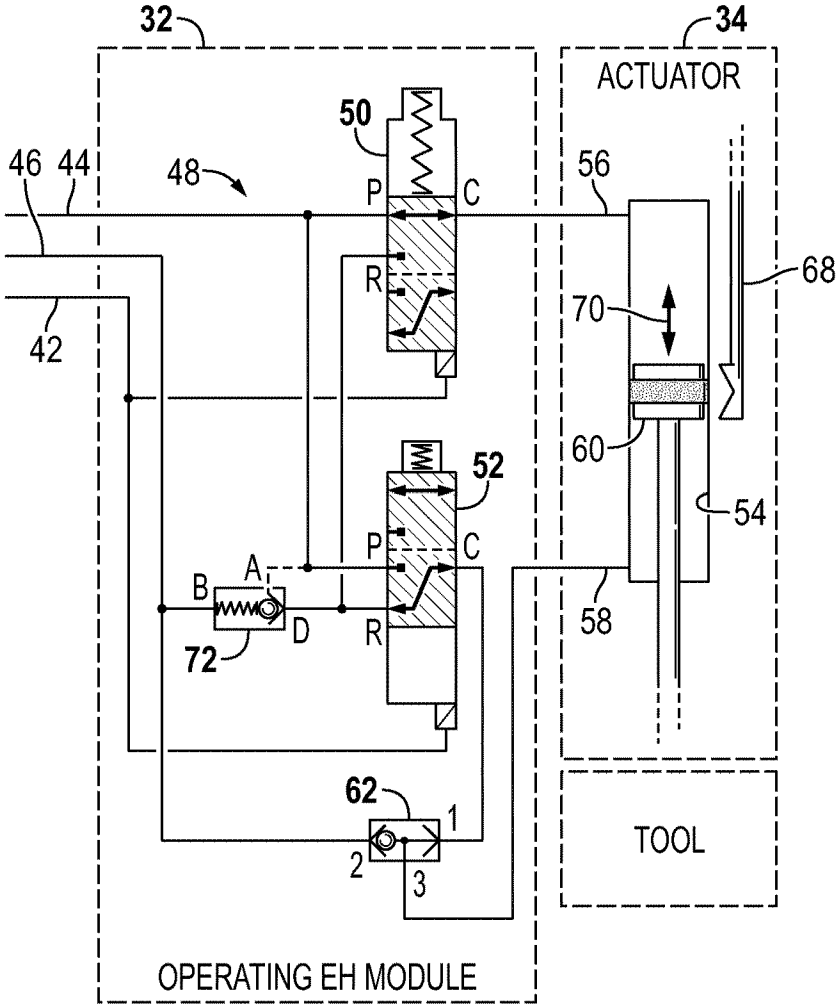
FIG. 13 is a schematic illustration similar to that of FIG. 9 but showing the operating module and actuator in a different operational position, according to an embodiment of the disclosure.

Referring generally to FIG. 13, an example of this embodiment of module 32 and actuator 34 is illustrated as operated in the mechanical intervention mode. In this example, the external tool 68 is similarly engaged with the actuator piston 60 or with a component coupled with the actuator piston 60. The external tool 68 may be moved to shift the actuator piston 60 in a plurality of directions, e.g. back and forth directions, as represented by arrow 70. The hydraulic circuitry of electro-hydraulic circuit 48 within operating module 32 is constructed to enable the free movement of the actuator piston 60 without incurring hydraulic lock.

As the actuator piston 60 is shifted in one direction or the other, hydraulic fluid within piston chamber 54 is allowed to drain to either first hydraulic line 44 or second hydraulic line 46 depending on the direction of the shift and the position of shuttle valve 62. As the mechanical shifting of actuator piston 60 forces hydraulic fluid out of piston chamber 54 on one side of actuator piston 60, fluid is freely allowed to flow into piston chamber 54 on an opposite side of actuator piston 60 from first hydraulic line 44 or second hydraulic line 46 depending on the position of shuttle valve 62. In some applications, the shuttle valve 62 may be spring biased to a given default position to enable the fluid flow path to be predetermined.

Figure 14:
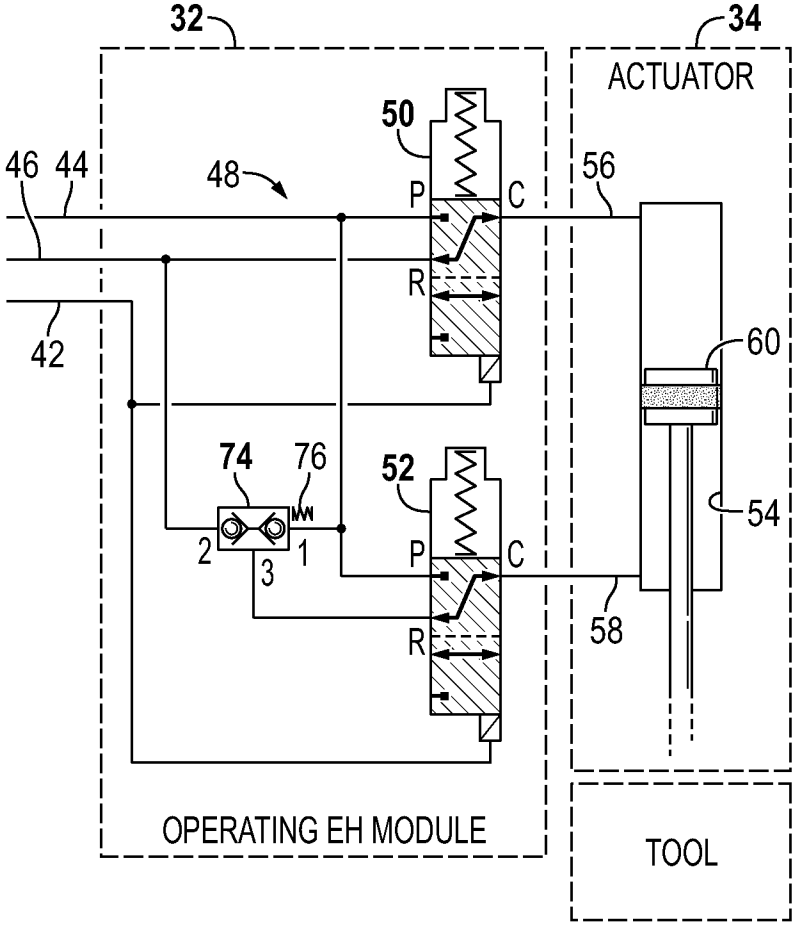
FIG. 14 is a schematic illustration of another example of an operating module and an actuator, according to an embodiment of the disclosure.

Referring generally to FIG. 14, another embodiment of operating module 32 is illustrated. In this embodiment, the first solenoid valve 50 and the second solenoid valve 52 are in normally closed configurations when they are not energized. In this example, the first and second solenoid valves 50, 52 work in cooperation with an inverse shuttle valve 74 having ports 1, 2 and 3. In some applications, the inverse shuttle valve 74 may be biased towards a predetermined, default position by, for example, a spring 76.

The inverse shuttle valve 74 enables operation in the three modes discussed above, including the pure hydraulic operation mode and the mechanical intervention mode with no hydraulic system lock. In the example illustrated, port 1 of the inverse shuttle valve 74 is coupled with first hydraulic line 44 and with ports P of the solenoid valves 50, 52. Port 2 of the inverse shuttle valve 74 is coupled with second hydraulic line 46 and port R of first solenoid valve 50. Port 3 of inverse shuttle valve 74 is coupled with port R of second shuttle valve 52.

To operate the actuator 34 and thus the corresponding device 36 in the electro-hydraulic mode, fluid in first hydraulic line 44 is pressurized. The pressurized fluid in first hydraulic line 44 is blocked at ports P of both solenoid valves 50, 52 and at port 1 of the inverse shuttle valve 74.

Figure 15:
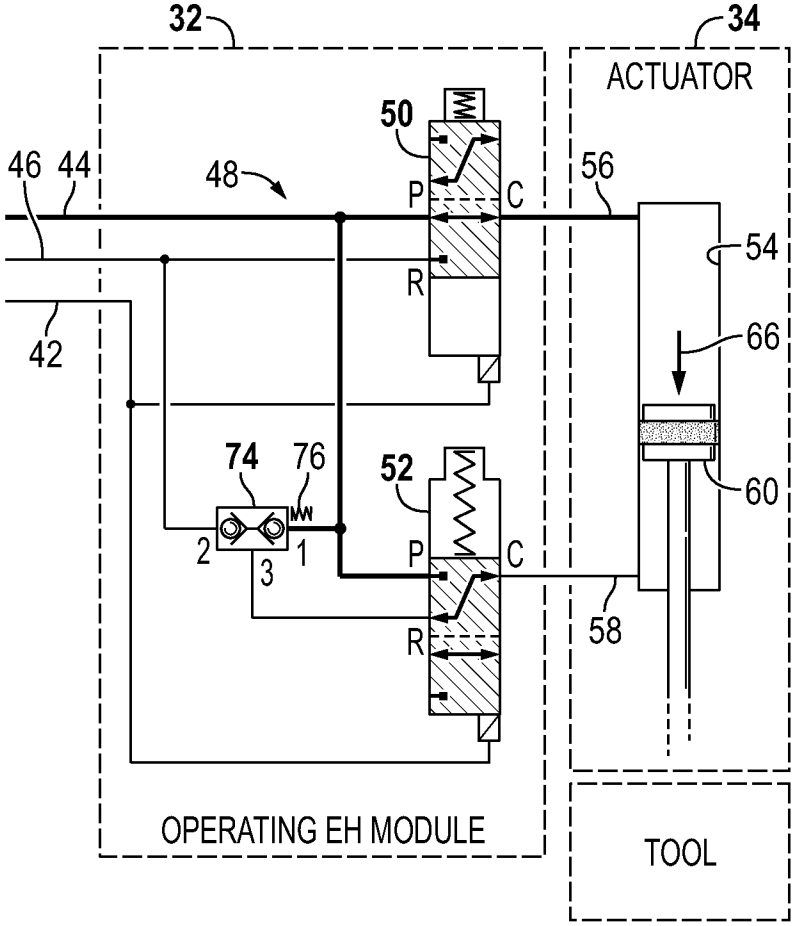
FIG. 15 is a schematic illustration similar to that of FIG. 14 but showing the operating module and actuator in a different operational position, according to an embodiment of the disclosure.

Actuation, e.g. shifting of hydraulic actuator 34, is triggered by energizing one of the solenoid valves 50 or 52. For example, the first solenoid valve 50 may be energized via a suitable electrical power and command signal supplied by electrical line 42 to cause movement of actuator piston 60 in a direction represented by arrow 66 in FIG. 15. When the first solenoid valve 50 is energized and activated, its P port is placed in communication with its C port and high-pressure fluid is communicated to piston chamber 54 on the illustrated upper side of actuator piston 60. On the opposite side of actuator piston 60, piston chamber 54 is in communication with second hydraulic line 46 through ports C and R of second solenoid valve 52 and through inverse shuttle valve 74 via shuttle valve ports 3 and 2. The high-pressure fluid acting on one side of actuator piston 60 forces the actuator piston 60 in the direction of arrow 66 while hydraulic fluid on the opposite side of actuator piston 60 drains to second hydraulic line 46.

Figure 16:
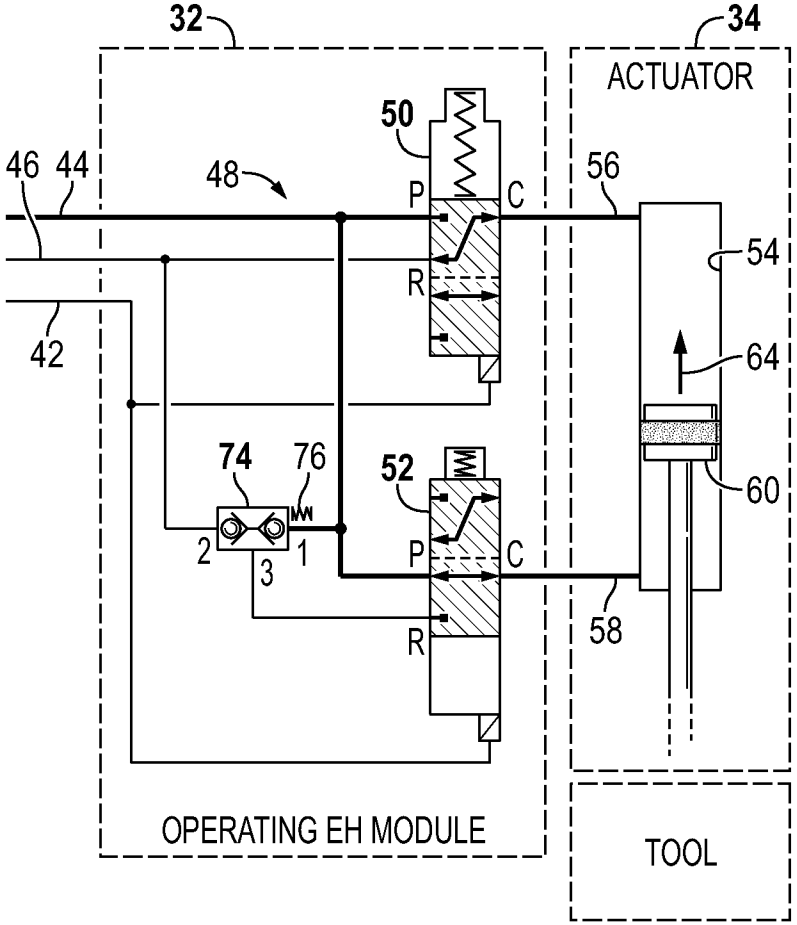
FIG. 16 is a schematic illustration similar to that of FIG. 14 but showing the operating module and actuator in a different operational position, according to an embodiment of the disclosure.

When the second solenoid valve 52 is energized via a suitable electrical power and command signal supplied by electrical line 42, the actuator piston 60 is moved in a second direction represented by arrow 64 in FIG. 16. When the second solenoid valve 52 is energized and activated, its P port is placed in communication with its C port and high-pressure fluid is communicated from first hydraulic line 44 to piston chamber 54 on the illustrated lower side of actuator piston 60. On the opposite side of actuator piston 60, piston chamber 54 is in communication with second hydraulic line 46 through ports C and R of first solenoid valve 50. The high-pressure fluid acting on one side of actuator piston 60 forces the actuator piston 60 in the direction of arrow 64 while hydraulic fluid on the opposite side of actuator piston 60 drains to second hydraulic line 46.

In this example, the first solenoid valve 50 and/or the second solenoid valve 52 may be deactivated (placed in a non-energized state) by cutting the supply of electrical power via electric line 42. Once the solenoid valves 50, 52 are in the non-energized state, the solenoid valves 50, 52 return to their normal closed flow position which blocks communication between first hydraulic line 44 and piston chamber 54 on both sides of actuator piston 60. If a pressure differential exists, the differential equalizes as hydraulic fluid on the high-pressure side of actuator piston 60 drains to the corresponding hydraulic line. As a result, movement of actuator piston 60 is stopped and the pressure differential across the actuator piston 60 is eliminated.

Figure 17:
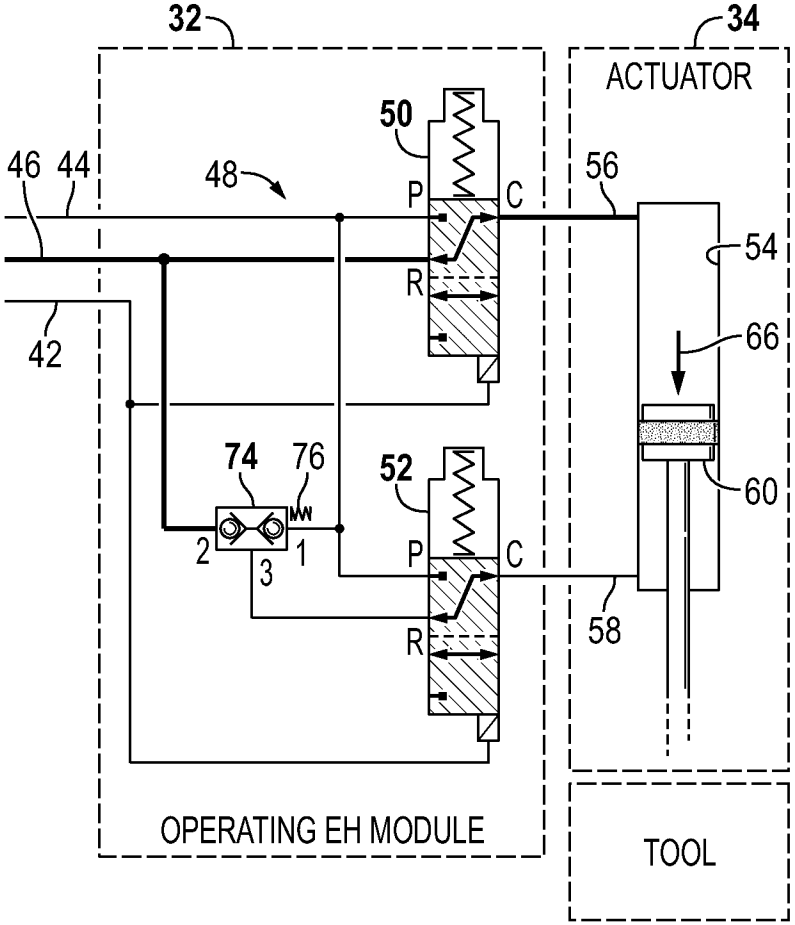
FIG. 17 is a schematic illustration similar to that of FIG. 14 but showing the operating module and actuator in a different operational position, according to an embodiment of the disclosure.

Referring generally to FIG. 17, an example of operation of the operating module 32 in a pure hydraulic mode is illustrated. The pure hydraulic mode is initiated by pressurizing second hydraulic line 46 without pressurizing first hydraulic line 44. In this example, the high-pressure fluid in second hydraulic line 46 is communicated to the illustrated upper portion of piston chamber 54 through ports R and C of first solenoid valve 50. The illustrated lower portion of piston chamber 34 on an opposite side of actuator piston 60 is isolated from the high-pressure fluid in second hydraulic line 46 by the inverse shuttle valve 74 via closed shuttle valve port 2. Consequently, the actuator piston 60 is forced in the direction indicated by arrow 66 as high-pressure fluid flows in through first solenoid valve 50 and lower pressure hydraulic fluid drains out through second solenoid valve 52 and inverse shuttle valve 74, as illustrated.

Figure 18:
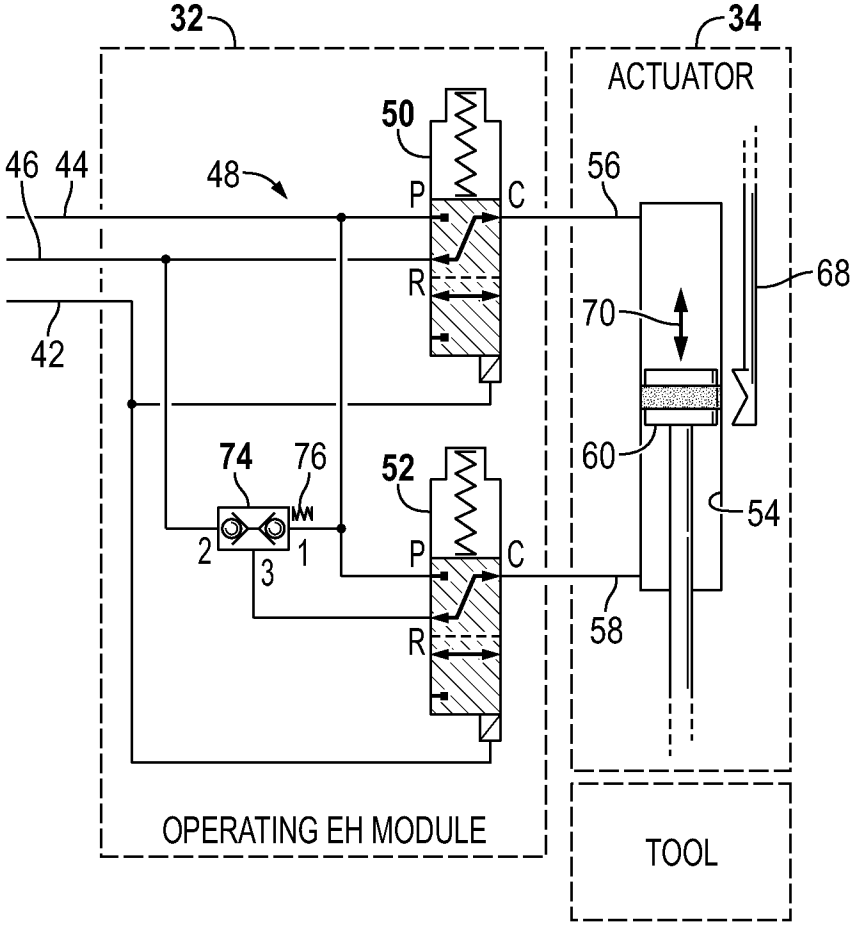
FIG. 18 is a schematic illustration similar to that of FIG. 14 but showing the operating module and actuator in a different operational position, according to an embodiment of the disclosure.

As illustrated in FIG. 18, this embodiment of operating module 32 and actuator 34 also may be operated in the mechanical intervention mode. In this example, the external tool 68 is similarly engaged with the actuator piston 60 or with a component coupled with the actuator piston 60. The external tool 68 may be moved to shift the actuator piston in a plurality of directions, e.g. back and forth directions, as represented by arrow 70. The hydraulic circuitry of electro-hydraulic circuit 48 within operating module 32 is constructed to enable the free movement of the actuator piston 60 without incurring hydraulic lock.

As the actuator piston 60 is shifted in one direction or the other, hydraulic fluid within piston chamber 54 is drained through either first hydraulic line 44 or second hydraulic line 46 depending on the direction of the shift with respect to actuator piston 60. At least with respect to movement in one direction, the hydraulic fluid also may drain through the inverse shuttle valve 74. As the mechanical shifting of actuator piston 60 forces hydraulic fluid out of piston chamber 54 on one side of actuator piston 60, fluid is freely allowed to flow into piston chamber 54 on an opposite side of actuator piston 60 from appropriate hydraulic line 44, 46. The inverse shuttle valve 74 may be biased or otherwise shuttled to a position which facilitates the flow of hydraulic fluid.

Figure 19:
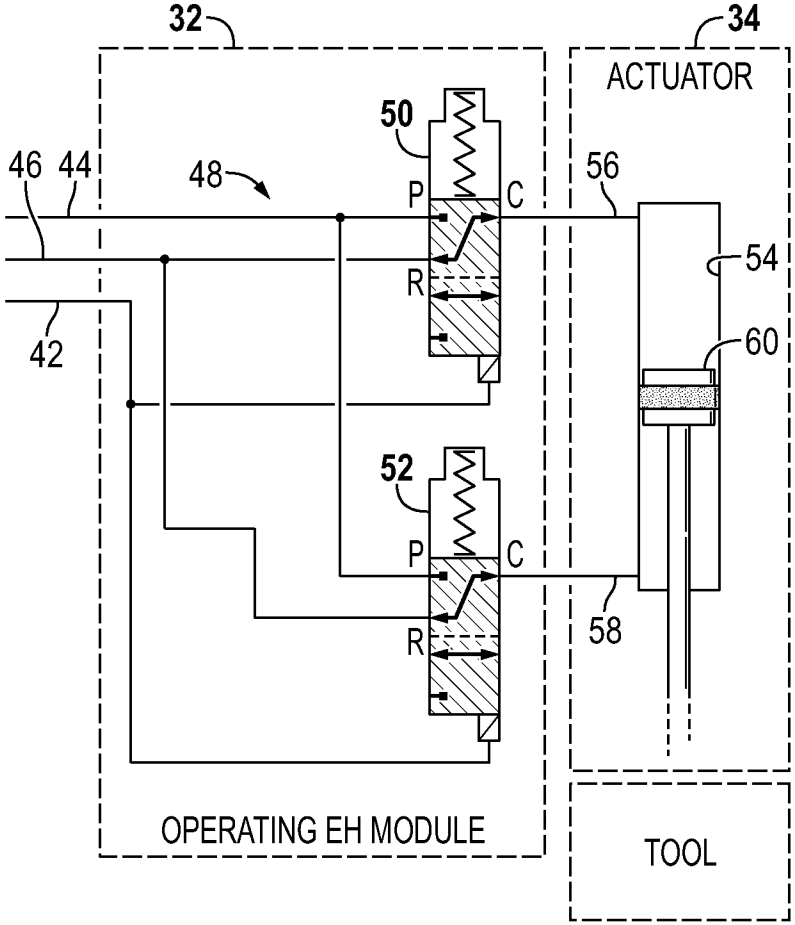
FIG. 19 is a schematic illustration of another example of an operating module and an actuator, according to an embodiment of the disclosure.

In this type of embodiment, the pure hydraulic operation function can be eliminated by removing the inverse shuttle valve 74, as illustrated in FIG. 19. For example, the inverse shuttle valve 74 can be removed and replaced with a plug or other suitable element which seals first hydraulic line 44 from second hydraulic line 46. However, the operating module 32 may be constructed with the same type of manifold or other structure with or without the inverse shuttle valve 74. This approach can be used to provide operating modules 32 with interchangeable configurations, e.g. embodiments comprising inverse shuttle valve 74 and embodiments without inverse shuttle valve 74. Such an approach provides flexibility in the manufacturing process such that two functionally different systems (with and without pure hydraulic mode) may be constructed using the same base components.

The overall system 30 may have a variety of components and configurations. For example, system 30 may be constructed as a well system comprising numerous types of well components, e.g. completion components, for use in a variety of well environments. Additionally, various numbers of operating modules 32, hydraulic actuators 34, and actuatable devices 36 may be used along various types of tubing strings in well applications and non-well applications.

Similarly, various electro-hydraulic circuit layouts may be constructed in a variety of manifolds or other operating module structures. The valves 50, 52 may comprise solenoid valves as illustrated or other types of valves which provide the desired functionality. Similarly, various shuttle valves, check valves, and inverse shuttle valves may be utilized in the electro-hydraulic circuit 48 to achieve the desired different modes of operation. The electric line 42 and the hydraulic lines 44, 46 may be routed along the tubing strings or other equipment in various patterns and forms able to deliver the appropriate electric signals and hydraulic signals. In some applications, the electric line and/or hydraulic lines may be incorporated into well equipment to provide a signal flow path along the interior or within the walls of the well equipment. In other applications, the electric line and/or hydraulic lines may be combined in a cable routed downhole and coupled with the one or more operating modules 32.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

an actuator coupled to a well tool;

an operating module hydraulically coupled to the actuator to shift the actuator between operational positions; and a surface control coupled to the operating module via an electric line, a first hydraulic line, and a second hydraulic line, the actuator being shifted between the operational positions via a selected operational mode of at least three distinct operational modes of actuating the well tool, the three distinct operational modes comprising:

an electro-hydraulic mode in which electric and hydraulic signals are provided to the operating module via the electric line and at least one of the first and second hydraulic lines;

a pure hydraulic mode in which hydraulic signals are provided to the operating module via at least one of the first and second hydraulic lines; and a mechanical mode in which the actuator is mechanically shifted by an external tool engaging the actuator without hydraulic lock occurring in the operating module.

2. The system as recited in claim 1, wherein the actuator comprises a plurality of actuators and the operating module comprises a plurality of operating modules, wherein each actuator is coupled with a corresponding operating module of the plurality of operating modules.

3. The system as recited in claim 1, wherein the actuator comprises an actuator piston movably mounted in a piston chamber and the operating module comprises a first solenoid valve controlled via an electric signal provided via the electric line and a second solenoid valve controlled via another electric signal provided via the electric line.

4. The system as recited in claim 3, wherein the first solenoid valve is hydraulically coupled with the piston chamber on a first side of the actuator piston and the second solenoid valve is hydraulically coupled with the piston chamber on a second side of the actuator piston.

5. The system as recited in claim 4, further comprising a shuttle valve hydraulically coupled between the first solenoid valve and the second solenoid valve.

6. The system as recited in claim 5, wherein when the first solenoid valve is energized in the electro-hydraulic mode the first solenoid valve blocks flow of pressurized hydraulic fluid from the first hydraulic line to the piston chamber such that the pressurized hydraulic fluid is directed through the shuttle valve, through the second solenoid valve, and into the piston chamber on the second side of the actuator piston to force movement of the actuator piston in a first direction.

7. The system as recited in claim 5, wherein when the second solenoid valve is energized in the electro-hydraulic mode the second solenoid valve blocks flow of pressurized hydraulic fluid from the first hydraulic line to the piston chamber such that the pressurized hydraulic fluid is directed through the shuttle valve, through the first solenoid valve, and into the piston chamber on the first side of the actuator piston to force movement of the actuator piston in a second direction.

8. The system as recited in claim 4, further comprising a shuttle valve and a piloted check valve which are each hydraulically coupled with at least the second solenoid valve.

9. The system as recited in claim 4, wherein the pure hydraulic mode enables pressurized hydraulic fluid to be supplied through the second hydraulic line to shift the actuator piston without electrical input to either of the first solenoid valve or the second solenoid valve.

10. The system as recited in claim 4, wherein when the first solenoid valve and the second solenoid valve are non-energized both the first solenoid valve and the second solenoid valve are in an open state allowing communication between the first hydraulic line and the piston chamber.

11. The system as recited in claim 4, wherein when the first solenoid valve and the second solenoid valve are non-energized both the first solenoid valve and the second solenoid valve are in a closed state blocking communication between the first hydraulic line and the piston chamber.

12. A system for controlling actuator movement, comprising:

an actuator hydraulically coupled with an operating module, the operating module being coupled with an electric line, a first hydraulic line, and a second hydraulic line, the operating module comprising:

a first solenoid valve; and a second solenoid valve, the first solenoid valve and the second solenoid valve being arranged to enable three distinct operational modes of actuating a well tool coupled to the actuator, the operational modes comprising: an electro-hydraulic mode in which the actuator is shifted in a plurality of directions by supplying an electric signal via the electric line and a hydraulic signal via the first hydraulic line; a pure hydraulic mode in which the actuator is shifted in at least one direction by supplying a hydraulic signal via the second hydraulic line without supplying an electric signal; and a mechanical mode in which the actuator is mechanically shifted in a plurality of directions by an external tool engaging the actuator without incurring hydraulic lock in the operating module.

13. The system as recited in claim 12, wherein the actuator comprises an actuator piston movable within a piston chamber, the first solenoid valve being hydraulically coupled with the piston chamber on a first side of the actuator piston and the second solenoid valve being hydraulically coupled with the piston chamber on a second side of the actuator piston.

14. The system as recited in claim 12, wherein the operating module further comprises a shuttle valve working in cooperation with the first solenoid valve and the second solenoid valve.

15. The system as recited in claim 14, wherein the shuttle valve is spring biased.

16. The system as recited in claim 12, wherein the operating module further comprises a shuttle valve and a piloted check valve working in cooperation with the first solenoid valve and the second solenoid valve.

17. A method, comprising:

coupling an operating module to an actuator;

providing the operating module with an electro-hydraulic mode, a pure hydraulic mode, and a mechanical mode;

selecting a mode from one of the electro-hydraulic mode, the pure hydraulic mode, or the mechanical mode; and shifting the actuator according to the selected mode to actuate a well tool positioned downhole in a wellbore, wherein shifting the actuator according to the mechanical mode comprises shifting the actuator in a plurality of directions via an external tool engaging the actuator without incurring hydraulic lock in the operating module.

18. The method as recited in claim 17, further comprising coupling the operating module with an electric control line, a first hydraulic control line, and a second hydraulic control line.

* * * * *